United States Patent [19]

Osswald

[11] 4,165,708

[45] Aug. 28, 1979

[54] DRIVE FOR WATERCRAFTS

[75] Inventor: Bernhard Osswald, Überlingen, Fed. Rep. of Germany

[73] Assignee: Bayerische Motoren Werke Aktiengesellschaft, Fed. Rep. of Germany

[21] Appl. No.: 855,776

[22] Filed: Nov. 29, 1977

[30] Foreign Application Priority Data

Dec. 4, 1976 [DE] Fed. Rep. of Germany ..... 2655126

[51] Int. Cl.[2] ..... B63H 1/14; B63H 5/06

[52] U.S. Cl. ..... 115/41 HT; 115/17

[58] Field of Search ..... 115/34 R, 41 R, 41 HT, 115/17, 18 R; 114/150; 214/140

[56] References Cited

U.S. PATENT DOCUMENTS

| | | | |
|---|---|---|---|
| Re. 27,932 | 2/1974 | Mett et al. | 115/41 HT |
| 2,891,498 | 6/1959 | Schroeder | 114/150 |
| 3,234,856 | 2/1966 | Martin | 114/150 |
| 3,915,111 | 10/1975 | Buddrus | 115/41 HT |

*Primary Examiner*—Trygve M. Blix
*Assistant Examiner*—D. W. Keen
*Attorney, Agent, or Firm*—Craig and Antonelli

[57] ABSTRACT

A drive arrangement for watercrafts, especially for boats with an engine installed inboard and with a Z-drive arranged outboard, which is pivotally arranged at the rear wall of the boat about an essentially horizontal axis and which can be pivoted by at least one lifting cylinder installed transversely to the pivot axis between the Z-drive and the boat wall; the lifting cylinder is thereby rigidly secured to the housing of the Z-drive and is connected with the place of connection on the side of the boat by way of a link structure which cooperates with the lifting cylinder as also with the connecting place by way of a pivot bearing.

16 Claims, 3 Drawing Figures

DRIVE FOR WATERCRAFTS

The present invention relates to a drive for watercrafts, especially for boats with an engine installed inboard and with a Z-drive arranged outboard, which is pivotally arranged about an essentially horizontal axis either indirectly or directly at the rear wall of the boat and which can be pivoted by means of at least one lift cylinder installed transversely to the pivot axis between the Z-drive and the boat wall, whereby the lift cylinder is rigidly connected with the housing of the Z-drive.

It has already been proposed in the prior art to so arrange the connection of two lift cylinders with the rear wall of the boat that the point of engagement of the lift cylinder during the lifting, lowering as well as trimming of the Z-drive moves along a track. For the constructive realization of this proposal, a rotatably supported roller is provided at the rear wall end of the lift cylinder, which is guided in a track-like guide way operatively connected with the rear wall. This roller moves between two guide surfaces with relatively small play in order that during a change from lifting to lowering and vice versa, the guide surface change of the roller, which occurs at that time, takes place with the smallest possible impact of the roller on the respective guide surface. The track-like guide way is arranged underneath the horizontal pivot axis and near the water level, whereby the guide surfaces are not protected against the water. This may lead already after short operating periods of the outboard drive to deposits on the guide surfaces as well as to corrosion thereat. Solid deposits in conjunction with the slight clearance of the roller between the guide surfaces effect a jamming of the roller between the guide surfaces, as a result of which a damaging or even a failure of the entire pivot or swinging drive may occur. Thus, neither a completely satisfactory functioning of the pivot drive over a longer operating period of time nor a high reliability is assured by means of the previously proposed construction of the rear wall connection of the lift cylinder.

The present invention is concerned with the task to so construct the rear wall connection of the lift cylinder that the influence of deposits on the movable connection is far-reachingly avoided.

The underlying problems are solved according to the present invention in that the lift cylinder is connected with the connecting place on the side of the boat by way of a link member which cooperates both with the lift cylinder as also with the connecting place by way of a pivot bearing.

The advantage of the present invention in comparison to the track-like guide way with its exposed guide surfaces or slide surfaces resides in the application of pivot bearings with slide surfaces that are closed off on all sides. A penetration of deposits into a pivot bearing can be counteracted in a simple manner by means of a narrow fit of pivot pin and bearing bush with a favorably constructed bearing lubrication as well as by means of a cover of the fitting gap between pin and bush, which can be realized with simple means. However, pivot bearings also offer in an advantageous manner the possibility of an encapsulated construction, preferably by the use of elastic means.

Accordingly, it is an object of the present invention to provide a drive for watercrafts which avoids by simple means the aforementioned shortcomings and drawbacks encountered in the prior art.

Another object of the present invention resides in a drive for watercrafts which assures a safe and uninterrupted operation over relatively long periods of time without danger of breakdowns due to deposits on certain parts or corrosion thereof.

A further object of the present invention resides in a drive for watercrafts, in which parts that may become jammed, are particularly protected against adverse external influences.

Still another object of the present invention resides in a drive for watercrafts which prevents by extremely simple means the penetration of particles that may deposit on the slide surfaces of relatively movable parts.

Still another object of the present invention resides in a drive for watercrafts in which exposed parts can be effectively and inexpensively protected by encapsulation.

These and other objects, features and advantages of the present invention will become more apparent from the following description when taken in connection with the accompanying drawing which shows, for purposes of illustration only, one embodiment in accordance with the present invention, and wherein.

Figure 1:
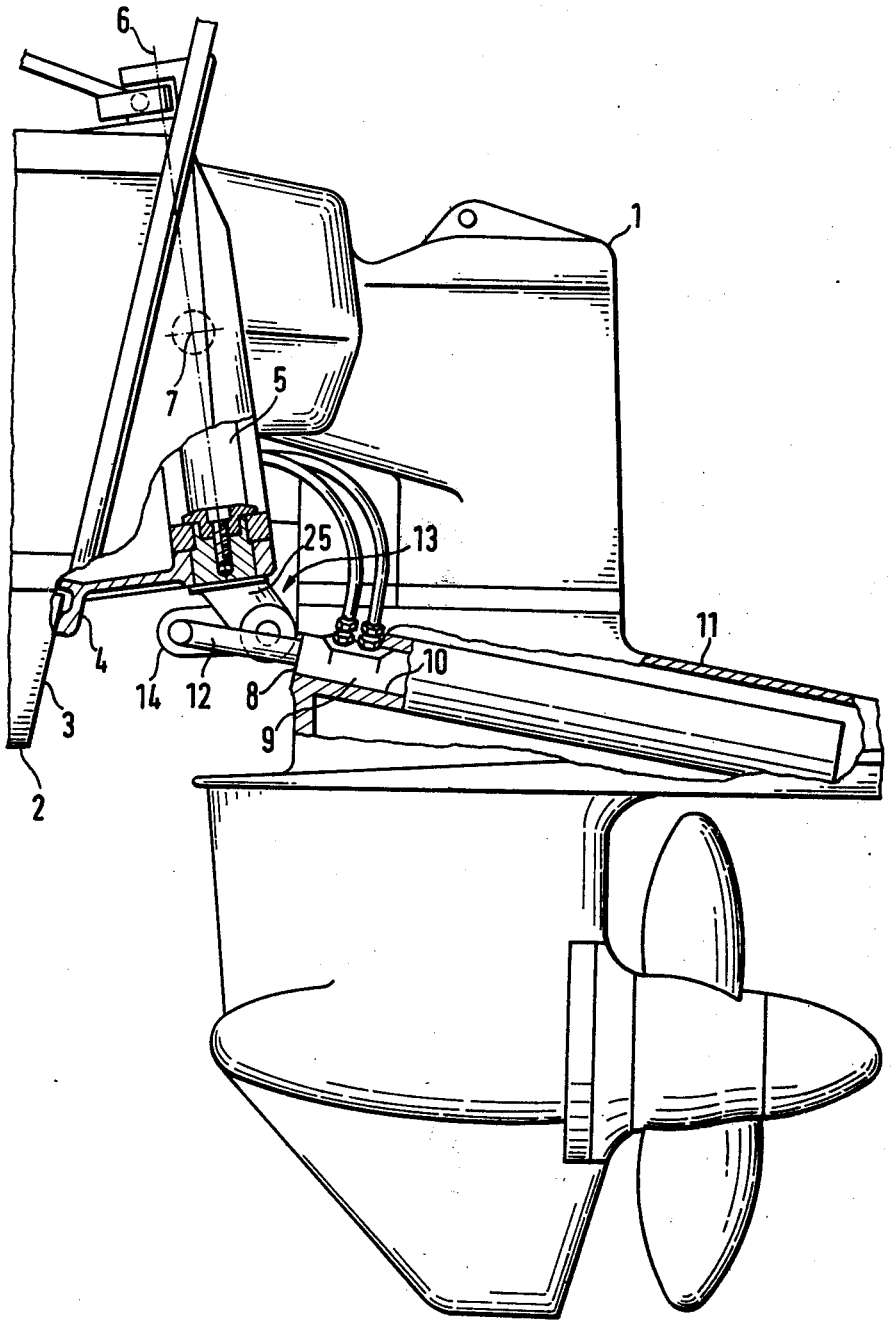
FIG. 1 is a somewhat schematic elevational view of a Z-drive in accordance with the present invention secured at a boat transom.

Referring now to the drawing wherein like reference numerals are used throughout the various views to designate like parts, FIG. 1 illustrates a drive constructed as Z-drive 1 for a boat 2 illustrated only in part with an inboard engine. The Z-drive 1 is arranged at the rear boat wall 3, also referred to as transom, by way of a transom plate 4 having a cardan ring 5. The cardan ring 5 is rotatably supported in the transom plate 4 about an essentially vertical axis 6 whereas, in contrast thereto, the Z-drive is pivotally supported at the cardan ring 5 about an essentially horizontal axis 7. The boat 2 is steered by means of movements of the Z-drive 1 about the vertical axis 6. The Z-drive 1 is pivoted up, i.e., is lifted, about the horizontal axis 7 for the transport of the boat 2, and is again pivoted down, i.e., lowered, for the operation thereof in water. Finally, the Z-drive 1 is also pivoted during the drive of the boat 2 about the horizontal axis 7 to achieve a favorable trimming position. A pivot drive or swing actuation including two hydraulically actuatable lift cylinders 8 (FIG. 2) is provided for the aforementioned movements of the Z-drive 1 about the horizontal or pivot axis 7, which are arranged below the pivot axis 7 and extend transversely with respect thereto. Both lifting cylinders 8 are securely arranged with their cylinders 9 in bores 10 (FIG. 1) within the housing 11 of the Z-drive 1. The piston rods 12 of the lift cylinders 8 rigidly connected at the Z-drive 1, engage at the connecting place 13 on the side of the boat by way of a fork-like link structure generally designated by reference numeral 14.

Figure 2:
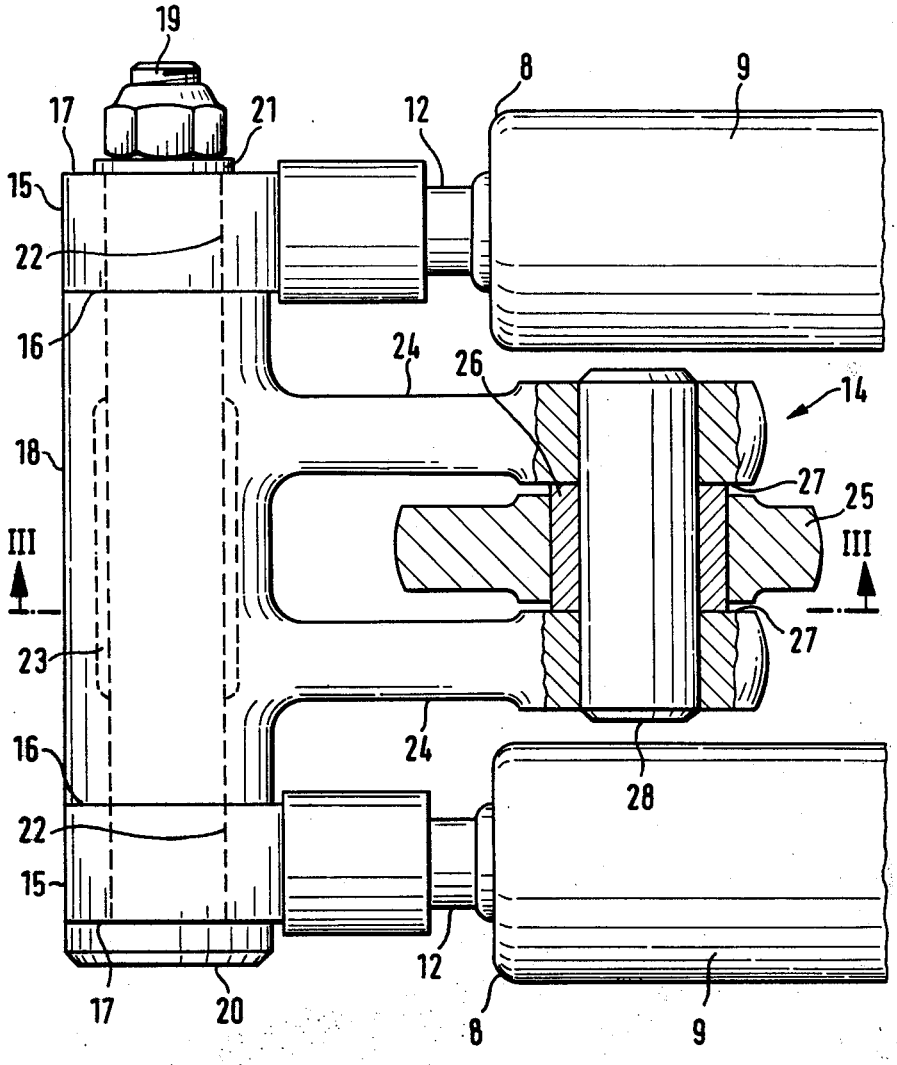
FIG. 2 is a partial plan view partly in cross section on the connection of the lifting mechanism on the side of the boat in accordance with the present invention.

As can be seen from FIG. 2, the lift cylinders 8 are arranged parallel to one another in the housing 11 of the Z-drive 1. Each of the piston rods 12 carries at the free end an eye or boss 15 with end surfaces 16 and 17 arranged parallel to one another. A bush or sleeve 18 is installed between the two eyes or bosses 15, which sealingly abuts on both sides against the end surfaces 16 of the bosses or eyes 15. The bush 18 is rotatably supported on a threaded bolt 19 connecting the two eyes or bosses 15. The threaded bolt 19 includes a bolt head 20 and is equipped with a washer 21 which sealingly abutting at the end surfaces 17 of the two bosses or eyes 15 cover off respectively the bearing gap between the threaded bolt 19 and the boss or eye bore 22. The bush 18 includes between its bearing places on the threaded bolt 19 an enlargement 23, into which a permanent lubricant may be placed. It can be further seen from FIG. 2 that two mutually parallel arms 24 which are directed in the same direction are arranged at the bush or sleeve 18. Bush 18 and arms 24 form the fork-like link member 14. A bearing lug or bracket 25 extends between the free end areas of the link arms 24. A bearing bush 26 is arranged within the same which projects at both ends beyond the bearing lug or bracket 25. The end surfaces of the bearing bush 26 abut sealingly at mutually parallel surfaces 27 provided on the link arms 24. The guide arms 24 or the link member 14 cooperate with the bearing bracket 25 by way of a fitted bolt 28. The fitted bolt 28 is rotatably supported in the bearing bush 26 and form-lockingly and force-lockingly cooperates with the link arms 24 by way of bores arranged within the same. As a result thereof, it is also assured with this pivot bearing of the link member 14 that a penetration of deposits into the movable connection is avoided.

Figure 3:
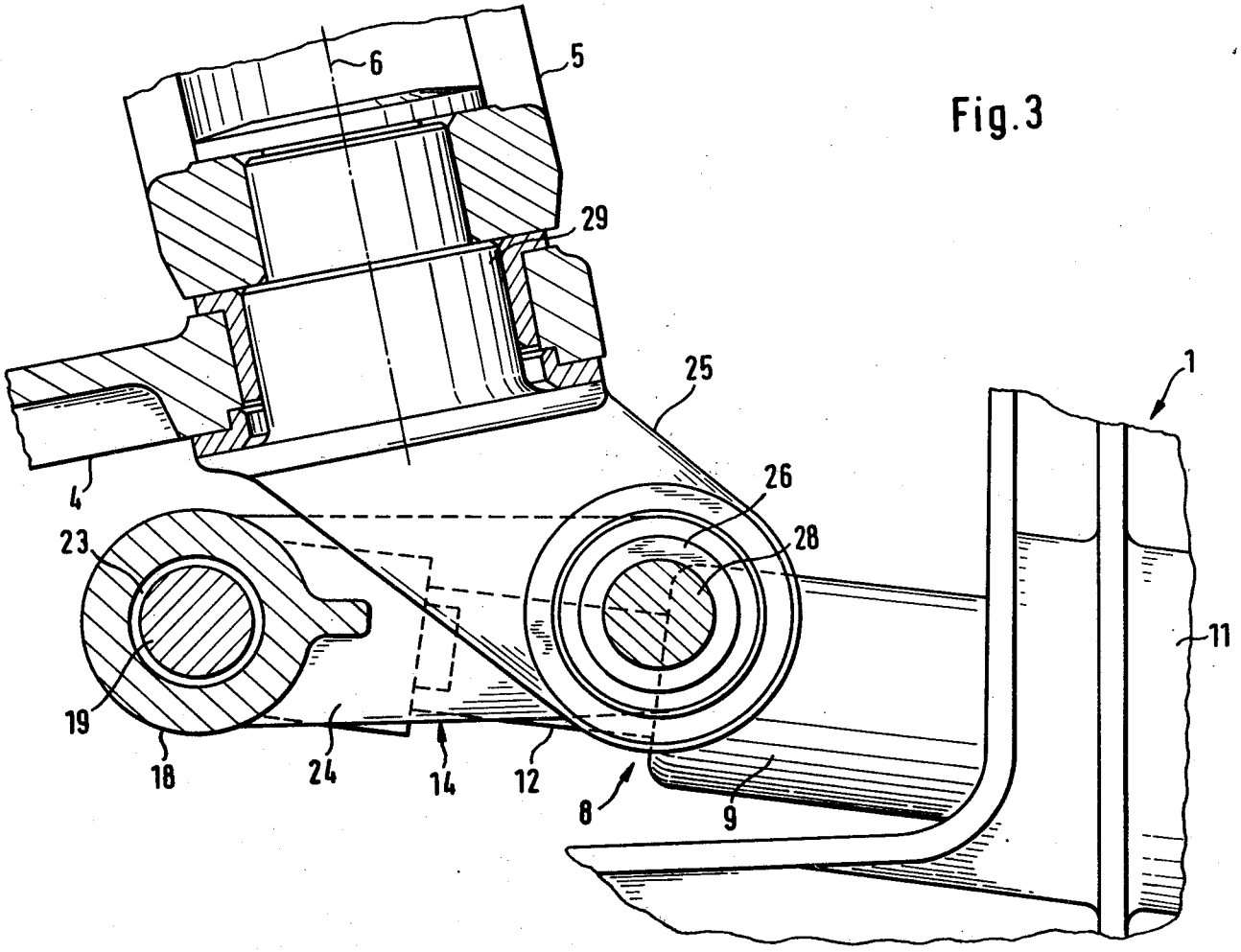
FIG. 3 is a cross-sectional view taken along line III—III of FIG. 2.

As can be seen from FIG. 3, the bearing lug or bracket 25 is operatively connected with the bearing pin 29 of the cardan ring 5 pivotal about the vertical axis 6. Preferably, the bearing pin 29 and the bearing lug 25 are made in one piece, as a result of which a high rigidity is obtained at the transition from the bearing pin 29 to the bearing lug 25. The bearing lug 25 may also be so arranged at the bearing pin 29 that it points toward the housing 11 of the Z-drive 1. This produces in an advantageous manner a compact and optically pleasing type of construction with relatively short lifting cylinders. It may also be appropriate to pivotally arrange the bearing bush 26 in the bearing lug 25.

The pivot bearings of the link member 14 can be completely encapsulated against fresh or sea water by the use of conventional elastic means. This can be achieved by means of elastic caps and/or with seals between the aforedescribed end surfaces of the pivot bearings.

While I have shown and described only one embodiment in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. A drive arrangement for watercrafts comprising drive means having a housing and pivotally arranged at a rear wall of the watercraft about an essentially horizontal axis, and at least one lift cylinder means for pivoting the drive means about said pivot axis, said lift cylinder means being rigidly and non-pivotally connected with the housing of the drive means, characterized in that the lift cylinder means is operatively connected with the connecting place on the side of the watercraft by way of a link means which cooperates with the lift cylinder means and also with the connecting place by way of respective pivot bearing means.

2. A drive arrangement according to claim 1, characterized in that the drive means is an outboard Z-drive operatively connected with an inboard engine, and the lift cylinder means is arranged substantially transversely to said pivot axis between the Z-drive and the wall of the watercraft.

3. A drive arrangement according to claim 2, characterized in that the Z-drive is pivotally arranged directly at the rear wall of the craft.

4. A drive arrangement according to claim 2, characterized in that the Z-drive is pivotally arranged indirectly at the rear wall of the craft.

5. A drive arrangement according to claim 2, characterized in that the pivot bearing means include a pin-bush bearing.

6. A drive arrangement according to claim 1, characterized in that the pivot bearing means of the link means are encapsulated by means of elastic caps.

7. A drive arrangement according to claim 1, characterized in that the pivot bearing means of the link means are encapsulated by seals.

8. A drive arrangement for watercrafts comprising drive means having a housing and pivotally arranged at a rear wall of the watercraft about an essentially horizontal axis, and at least one lift cylinder means for pivoting the drive means about said pivot axis, said lift cylinder means being rigidly connected with the housing of the drive means, characterized in that the lift cylinder means is operatively connected with the connecting place on the side of the watercraft by way of a link means which cooperates with the lift cylinder means as also with the connecting place by way of pivot bearing means, with lift cylinder means arranged parallel at a distance to each other in the housing of the drive means and including piston rods pointing in the direction toward the connecting place, characterized in that the piston rods are equipped with bosses and are connected with each other by way of a bearing bolt, on which the link means including a sleeve means with projecting arms is rotatably supported, the sleeve means sealingly abutting with its end faces against the end faces of the bosses.

9. A drive arrangement according to claim 8, characterized in that the arms of the link means sealingly abut with mutually parallel opposite surfaces thereof at the end faces of a bearing bush arranged in a bearing lug of the connecting place, and in that a bolt rotatably supported in the bearing bush is provided, with which the link arms engage.

10. A drive arrangement according to claim 9, characterized in that the last-mentioned bolt is a fitted bolt which is arranged with a press-fit in bores of the link arms.

11. A drive arrangement according to claim 10, which is additionally rotatably constructed about an essentially vertical axis, characterized in that the bearing lug is arranged at a bearing pin means of a cardan ring means aligned substantially with the vertical axis, bearing places for the horizontal pivot axis being provided at said cardan ring means.

12. A drive arrangement according to claim 11, characterized in that the pivot bearing means of the link means are encapsulated by means of elastic caps.

13. A drive arrangement according to claim 12, characterized in that the pivot bearing means of the link means are encapsulated by seals.

14. A drive arrangement according to claim 13, characterized in that the drive means which is an outboard Z-drive operatively connected with an inboard engine, and the lift cylinder means is arranged substantially transversely to said pivot axis between the Z-drive and the wall of the watercraft.

15. A drive arrangement according to claim 14, characterized in that the pivot bearing means are formed by a pin-bush pairing.

16. A drive arrangement for watercrafts comprising drive means having a housing and pivotally arranged at a rear wall of the watercraft about an essentially horizontal axis, and at least one lift cylinder means for pivoting the drive means about said pivot axis, said lift cylinder means being rigidly connected with the housing of the drive means, characterized in that the lift cylinder means is operatively connected with the connecting place on the side of the watercraft by way of a link means which cooperates with the lift cylinder means as also with the connecting place by way of pivot bearing means, and wherein said drive arrangement is additionally rotatably constructed about an essentially vertical axis, characterized in that a bearing lug is arranged at a bearing pin means of a cardan ring means aligned substantially with the vertical axis, bearing places for the horizontal pivot axis being provided at said cardan ring means.

* * * * *